US006975237B2

(12) United States Patent
Barton et al.

(10) Patent No.: US 6,975,237 B2
(45) Date of Patent: Dec. 13, 2005

(54) SYSTEM, CONTROLLER AND METHOD OF DETECTING A HAZARDOUS CONDITION WITHIN AN ENCLOSURE HAVING A VENTILATION SYSTEM

(75) Inventors: Steven M. Barton, Everett, WA (US); Daniel F. Lewinski, Stanwood, WA (US); Steven M. Loukusa, Bothell, WA (US)

(73) Assignee: The Boeing Company, Chicago, IL (US)

( * ) Notice: Subject to any disclaimer, the term of this patent is extended or adjusted under 35 U.S.C. 154(b) by 62 days.

(21) Appl. No.: 10/339,938

(22) Filed: Jan. 10, 2003

(65) Prior Publication Data

US 2004/0135695 A1 Jul. 15, 2004

(51) Int. Cl.[7] ..... G08B 17/10
(52) U.S. Cl. ..... 340/628; 340/511; 340/629
(58) Field of Search ..... 340/628, 629, 340/630, 511, 588, 584, 500, 501, 691.3

(56) References Cited

U.S. PATENT DOCUMENTS 4,818,970 A * 4/1989 Natale et al. ..... 340/539.26
4,977,818 A * 12/1990 Taylor et al. ..... 454/342
5,764,149 A 6/1998 Patel et al.
6,072,397 A * 6/2000 Ostrowski ..... 340/588
6,118,381 A * 9/2000 James ..... 340/577
6,134,667 A * 10/2000 Suzuki et al. ..... 713/300
6,249,220 B1 * 6/2001 Kaji et al. ..... 340/511
6,377,183 B1 4/2002 Baker et al.
6,407,671 B1 * 6/2002 Mulvihill et al. ..... 340/628

* cited by examiner

*Primary Examiner*—Jeffery Hofsass
*Assistant Examiner*—Eric Blount
(74) *Attorney, Agent, or Firm*—Alston & Bird LLP

(57) ABSTRACT

A detection system is provided for detecting at least one hazardous condition in an enclosure including a ventilation system, where the ventilation system is capable of operating in either an on or off mode. The system includes at least one detector capable of detecting at least one level representative of the severity of the hazardous conditions within the enclosure, where each level is associated with a pre-alarm threshold and an alarm threshold that is higher than the pre-alarm threshold. The detection system also includes a controller capable of operating the ventilation system in the off or on mode when at least one level detected by the detectors is above or below the respective pre-alarm threshold, respectively. The controller is also capable of reporting the hazardous condition when the at least one level is above or below the respective alarm threshold, respectively.

32 Claims, 7 Drawing Sheets

SYSTEM, CONTROLLER AND METHOD OF DETECTING A HAZARDOUS CONDITION WITHIN AN ENCLOSURE HAVING A VENTILATION SYSTEM

FIELD OF THE INVENTION

The present invention relates generally to systems and methods of detecting hazardous conditions such as fires, explosive atmospheres, toxic, or other damaging environments and, more particularly, relates to systems, controllers and methods of detecting hazardous conditions within an enclosure that includes a ventilation system.

BACKGROUND OF THE INVENTION

Many structures, such as buildings, and systems, such as aircraft, contain some type of smoke or fire detection system that detects smoke or fire, and thereafter provides an indication that a fire may exist within the structure or system. In many structures or systems, such smoke or fire detection systems are installed within enclosures that include some type of ventilation that provides airflow through the enclosure. In the context of aircraft, for example, cargo or baggage compartments are provided with ventilation to control the temperature and air quality within the compartment. Such ventilation in enclosures, however, significantly impacts the ability of smoke or fire detection systems to detect smoke or fire.

Typically, smoke or fire detectors are arranged in one of two manners. As shown in FIG. 1, one or more spot detectors can be arranged in the enclosure, such as on the ceiling. Alternatively, an aspirated system (not shown) includes ducts that draw air from one or more locations to a central detector. Thus, as shown in FIG. 1, when a fire 10 starts in an unventilated enclosure 12, the fire typically produces a plume 14 of smoke that rises to the ceiling of the enclosure, spreads out in a relatively strong concentration and fills the enclosure from the ceiling down to the floor. As the plume spreads out in a relatively strong concentration, smoke detectors 16 can easily detect the smoke such that the system can thereafter report a fire within the enclosure.

Referring now to FIG. 2, in contrast to unventilated enclosures, ventilated enclosures 17 generally have at least one air inlet 18 whereby air enters the enclosure, and at least one air outlet 20 whereby air exists the enclosure. When a fire 10 starts in a ventilated enclosure, then, the plume 14 of smoke does not rise predictably as in an unventilated enclosure 12. Instead, the plume of smoke is disrupted and diluted by the flow of air through the enclosure, where movement of smoke is dominated by the airflow patterns. As such, unless the ventilation carries the smoke directly to one of the detectors 16, more time is required for the smoke to reach the detectors in sufficient concentration to trip an alarm, as compared to instances of fires in unventilated enclosures. Furthermore, in instances in which a small fire occurs in the enclosure, the ventilation may prevent detection of the fire altogether. In this regard, if the fire is small enough, ventilation may cause the smoke plume concentration in the enclosure to stop increasing when the quantity of the smoke plume exhausted from the enclosure via the air outlet is equal to the quantity generated by the fire. As a result, the smoke plume concentration may not reach an alarm concentration, thereby allowing the small fire to propagate undetected.

Putting further constraints on performance of smoke or fire detection systems is that fact that many regulatory authorities place limits on the amount of smoke allowed to exist in a structure or system before being detected by an appropriate smoke or fire detection system. In the context of aircraft, for example, the Federal Aviation Administration (FAA) has imposed limits on the amount of smoke allowed to exist undetected in many portions of aircraft. In addition, the FAA over time has reduced limits on the amount of time allowed for a smoke or fire detection system to detect a fire in many portions of aircraft. Currently, for example, in cargo or baggage compartments, FAA Federal Aviation Regulation (FAR) 25.858(a) requires any certified smoke or fire detection system to provide a visual indication to aircraft flight crew within one minute after the start of a fire within the cargo or baggage compartments.

Conventionally, improving of detection performance of smoke or fire detection systems requires increasing the number of smoke or fire detectors, reducing the ventilation in the affected areas of the aircraft and/or increasing the sensitivity of the smoke or fire detectors. And whereas each technique for improving detection performance of smoke or fire detection systems is adequate, each has drawbacks. Increasing the number of fire detectors, for example, increases system costs associated with new detectors, as well as new electrical power sources, wiring, flight deck messages, plumbing complexity, and cargo liner and structural interfaces. Reducing ventilation generally results in financial losses to the aircraft operator in that to reduce the ventilation, the quantity of some cargo types must typically be reduced, thus reducing the capacity of the affected area and the overall aircraft.

While increasing the sensitivity of the smoke or fire detectors will increase system performance, the number of false alarms initiated by the smoke or fire detectors will also increase. In this regard, the frequency of false alarms is often considered one of the biggest problems with conventional smoke or fire detection systems. Increasing false alarms, in turn, decreases system reliability and can impose considerable costs for the aircraft operator and can result in unnecessary bodily injury to passengers, as described below.

False alarms can be generated when nuisance sources such as dust, moisture, and/or gasses, are presented to a detector at a level exceeding the alarm threshold. And whenever a fire alarm is triggered on an aircraft, for example, the aircraft crew typically discharge fire extinguishers in the affected area, divert the aircraft to the nearest airport, and occasionally initiate an emergency evacuation of the aircraft. By increasing the number of false alarms, the airlines incur costs associated with replacing expended fire extinguishers, accommodating inconvenienced passengers and dispatching the aircraft from an unplanned destination. In addition, unnecessary emergency evacuations can result in unnecessary passenger injuries, which can occur during emergency evacuations.

Although the foregoing has described systems and structures as including smoke or fire detection systems, it should be appreciated that such systems and/or structures can additionally or alternatively include detectors for detecting other types of hazardous conditions. For example, such systems and/or structures can include detection systems for detecting certain gases, such as carbon monoxide, that can be every bit as dangerous as fire or smoke (caused by fire). Thus, it should also be appreciated that such detection can have the same type of drawbacks as smoke or fire detection systems, described above.

SUMMARY OF THE INVENTION

In light of the foregoing background, the present invention provides a system, controller and method of detecting a hazardous condition in an enclosure including a ventilation system. The system, controller and method of embodiments of the present invention include a pre-alarm threshold at which point the ventilation system of the enclosure can be controlled to alter the air flow through the enclosure to thereby decrease the amount of time required for the level representative of the severity of the hazardous condition to reach an alarm threshold. As such, the system, controller and method of embodiments of the present invention are capable of detecting hazardous conditions with a reaction time shorter than conventional detection systems and methods. Also, the system, controller and method of embodiments of the present invention can operate with a higher alarm threshold than conventional detection systems and methods. Additionally, or alternatively, the system, controller and method of embodiments of the present invention can detect levels representative of the severity of the hazardous condition while discriminating against, or otherwise compensating for, nuisance sources. As such, the system, controller and method of such embodiments can operate with fewer false alarms than conventional detection systems and methods.

According to one aspect of the present invention, a detection system capable of detecting at least one hazardous condition is provided. The system is capable of detecting any one or more of a number of hazardous conditions, such as an aerosol, a particulate, a gaseous product and/or a fire. The system is adapted for operation in an enclosure including a ventilation system, where the ventilation system is capable of operating in either an on or off mode. In the on mode, the ventilation system at least partially permits air to pass through the enclosure, and in the off mode the ventilation system at least partially prohibits air from passing through the enclosure. The system includes at least one detector capable of detecting at least one level representative of the severity of the hazardous conditions within the enclosure. For example, the detectors can detect a concentration of an aerosol, such as smoke, a predefined gas, such as carbon monoxide, and/or a predetermined amount of heat. Additionally, the detectors can be capable of compensating for at least one nuisance source while detecting the levels representative of the severity of the hazardous conditions.

In addition to the detectors, the detection system includes a controller electrically connected to the detectors and the ventilation system of the enclosure. In operation, the controller is capable of operating the ventilation system in the on or off mode based upon the levels representative of the severity of the hazardous conditions detected by the detectors and a pre-alarm threshold, where each level is associated with a pre-alarm threshold. In this regard, the controller can be capable of operating the ventilation system in the off mode when at least one level is above a respective pre-alarm threshold. Alternatively, the controller can be capable of operating the ventilation system in the on mode when at least one level is below a respective pre-alarm threshold. Advantageously, the controller can be capable of automatically operating the ventilation system, such as in the off mode when the level is above the pre-alarm threshold.

In addition to operating the ventilation system, the controller is capable of reporting the hazardous conditions based upon the levels detected by the detectors and an alarm threshold, where each level is associated with an alarm threshold. In this regard, the controller can be capable of reporting the hazardous conditions when at least one level detected by the detectors is above a respective alarm threshold, such as the 4% per foot to 18% per foot obscuration per Technical Standard Order (TSO) Clc of the Federal Aviation Administration (FAA), where the pre-alarm threshold is lower than the alarm threshold. Alternatively, the controller can be capable of reporting the hazardous conditions when at least one level detected by the detectors is below the respective alarm threshold, where the pre-alarm threshold is higher than the alarm threshold.

After operating the ventilation system in the off or on mode, the controller can be capable of operating the ventilation system in the on or off mode, respectively, if, after a predefined time, the levels detected by the at least one detector are below or above the respective alarm thresholds, respectively. In this regard, the controller can also be capable of increasing or decreasing the respective pre-alarms threshold if, after the predefined time, the levels detected by the detectors are above or below the respective pre-alarm thresholds and below or above the respective alarm thresholds, respectively.

A controller and method of detecting a hazardous condition are also provided.

BRIEF DESCRIPTION OF THE DRAWINGS

Figure 1:
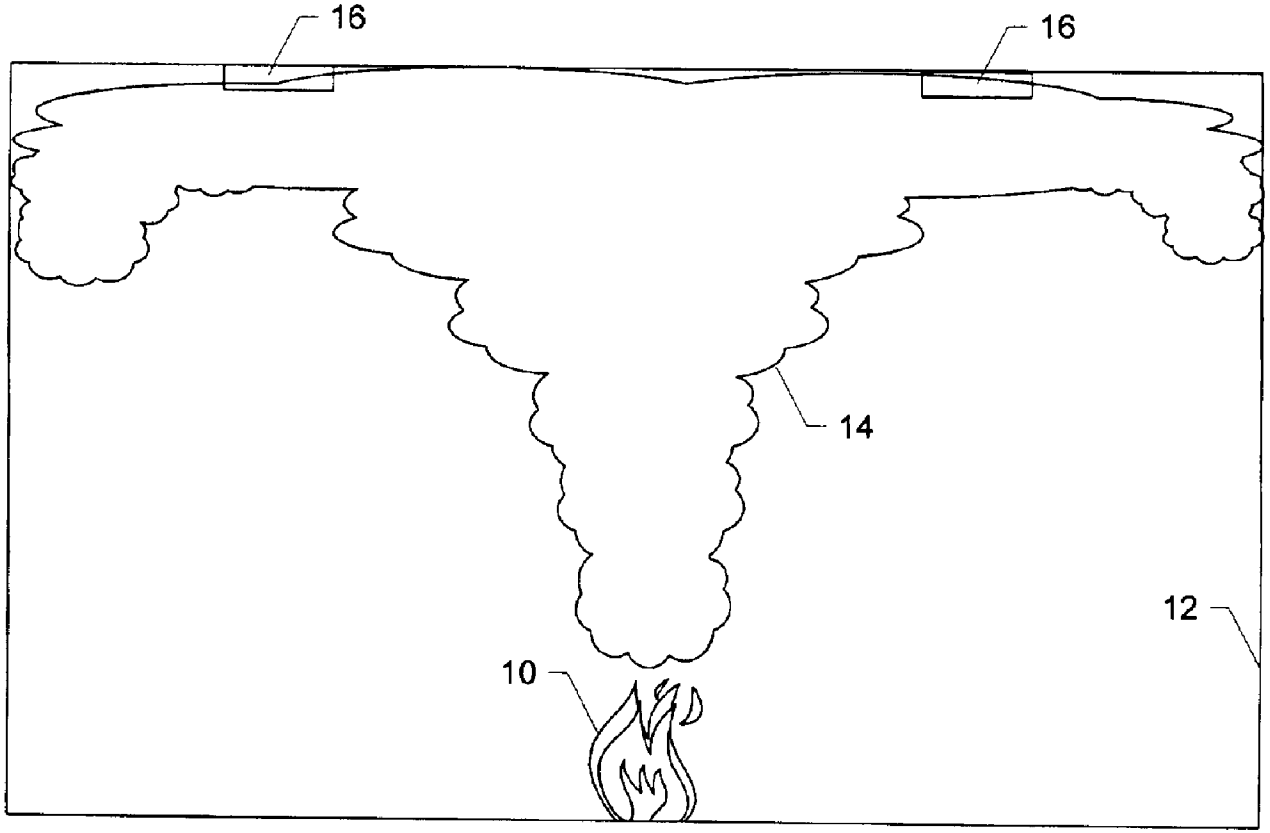
Figure 2:
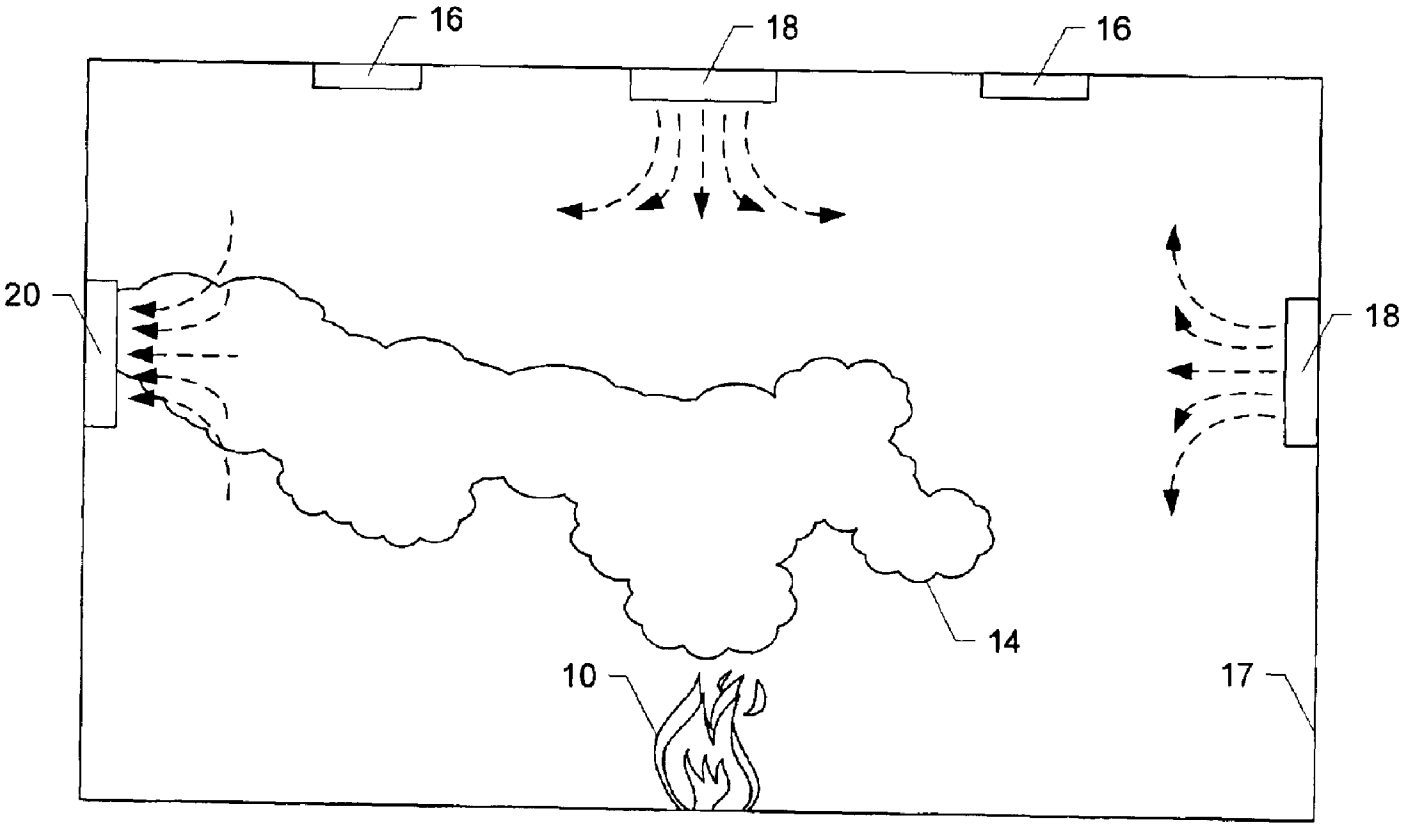
Figure 3:
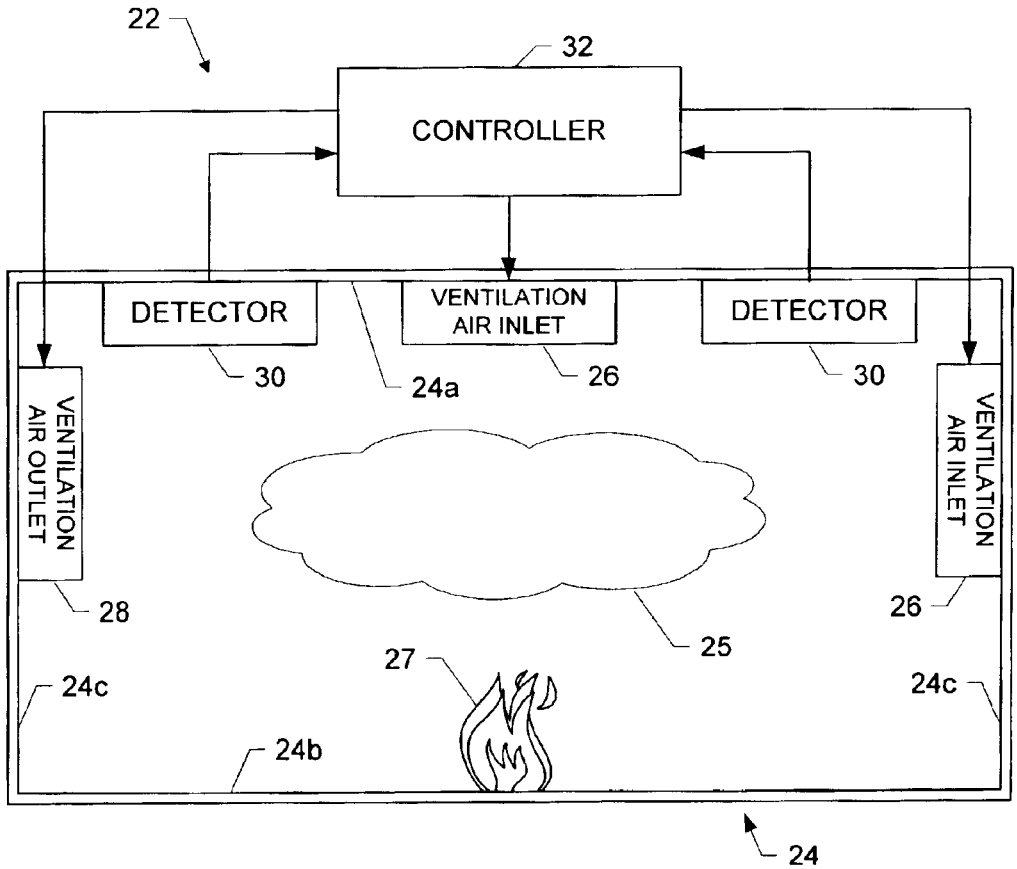
Figure 4:
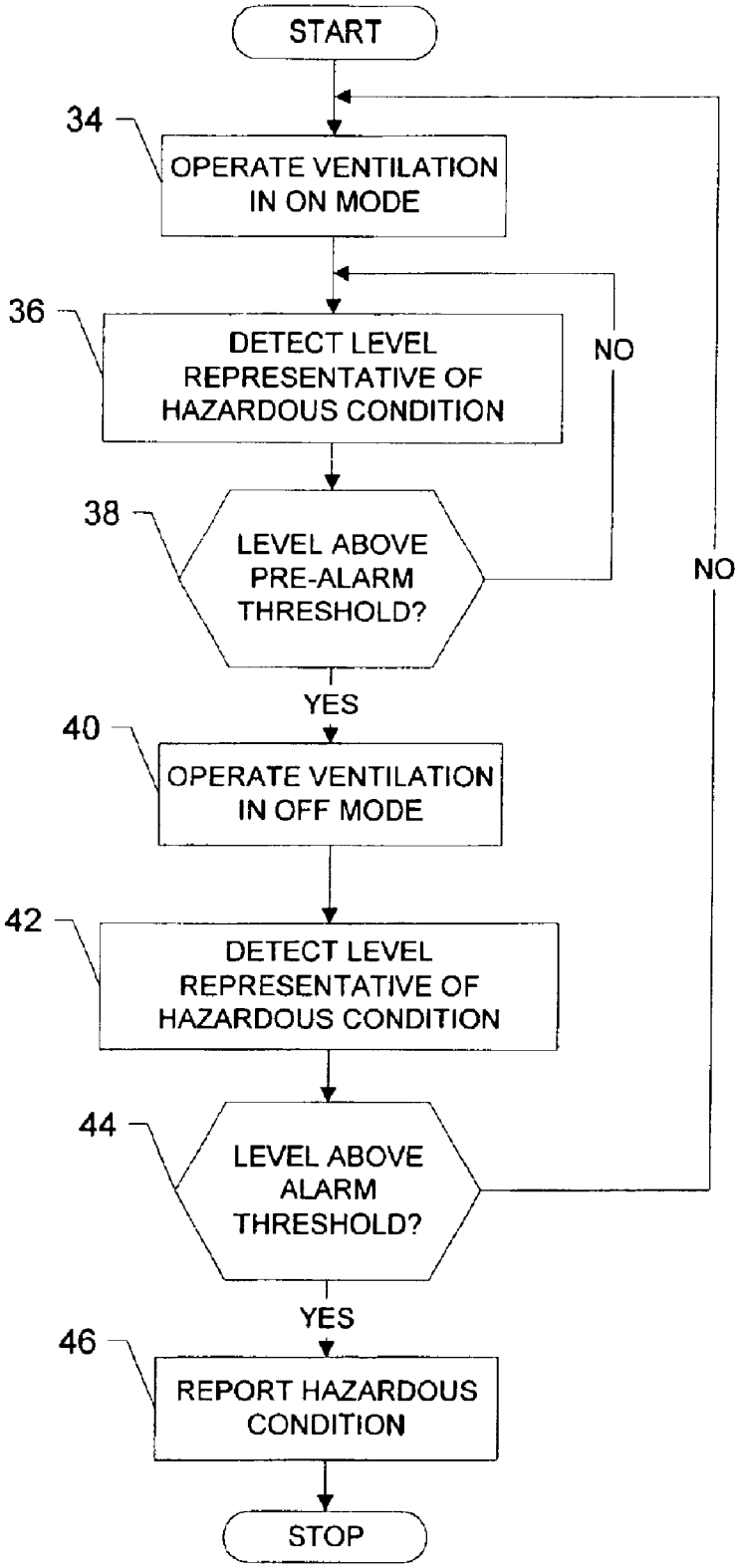
Figure 5:
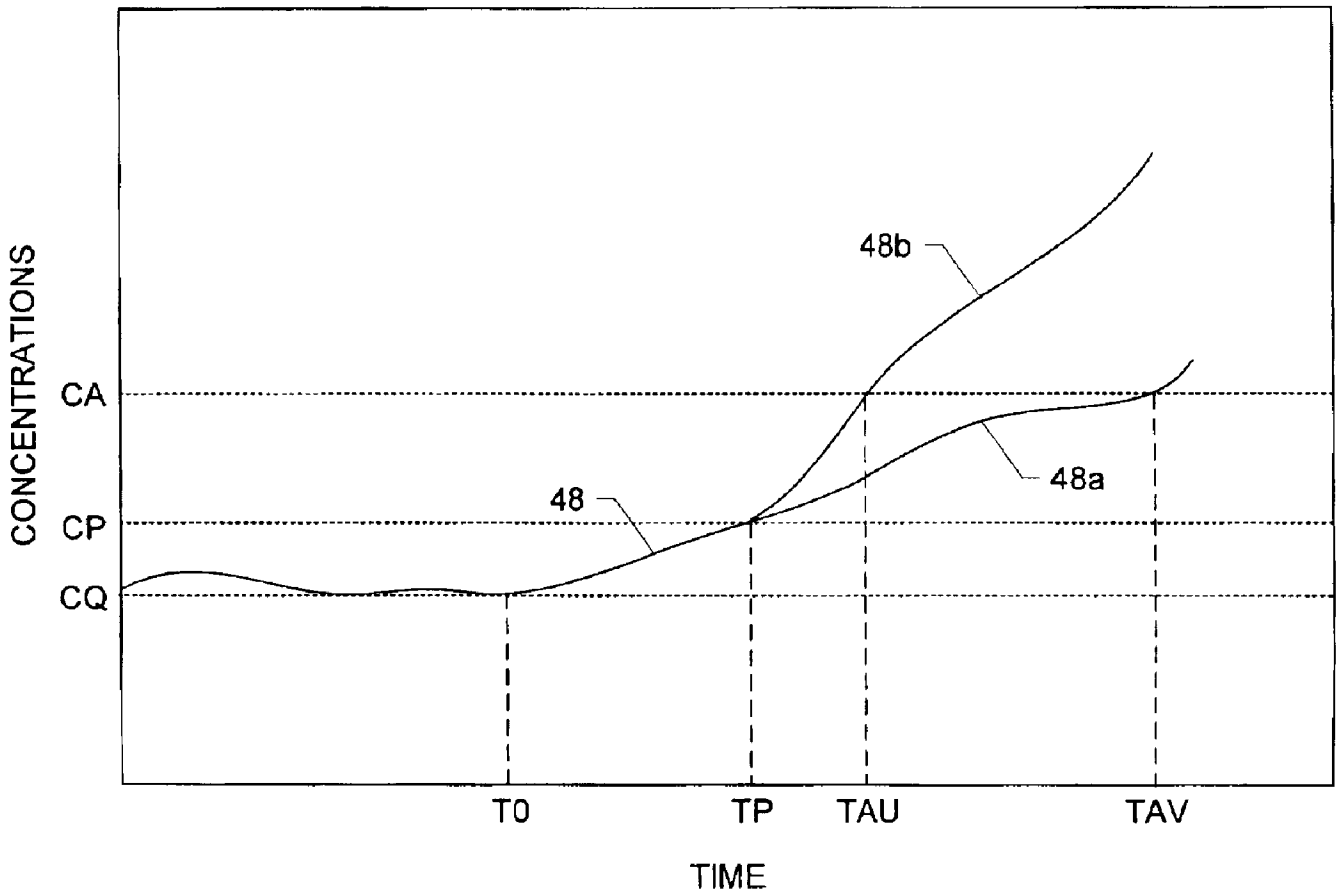
Figure 6:
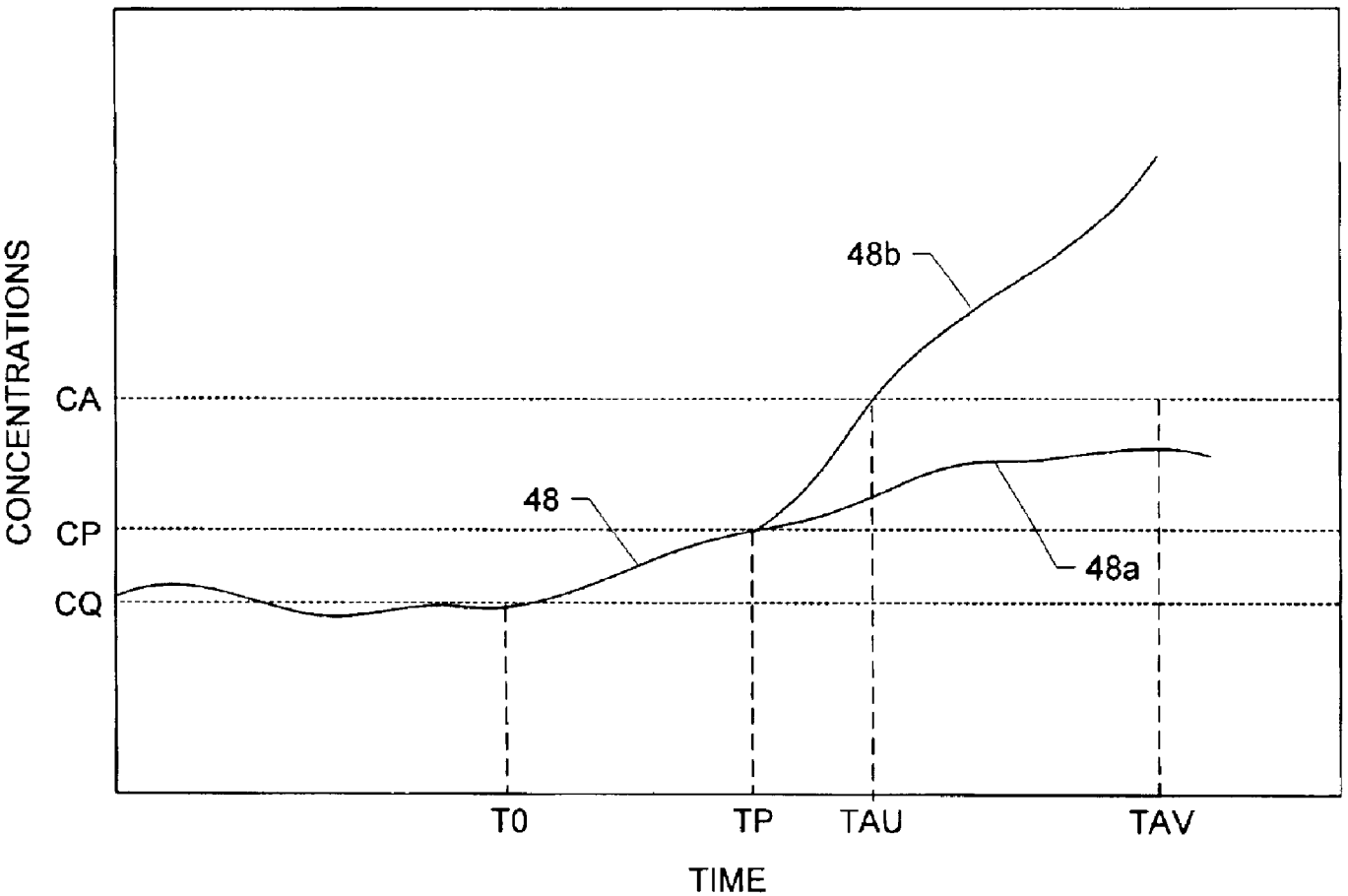
Figure 7:
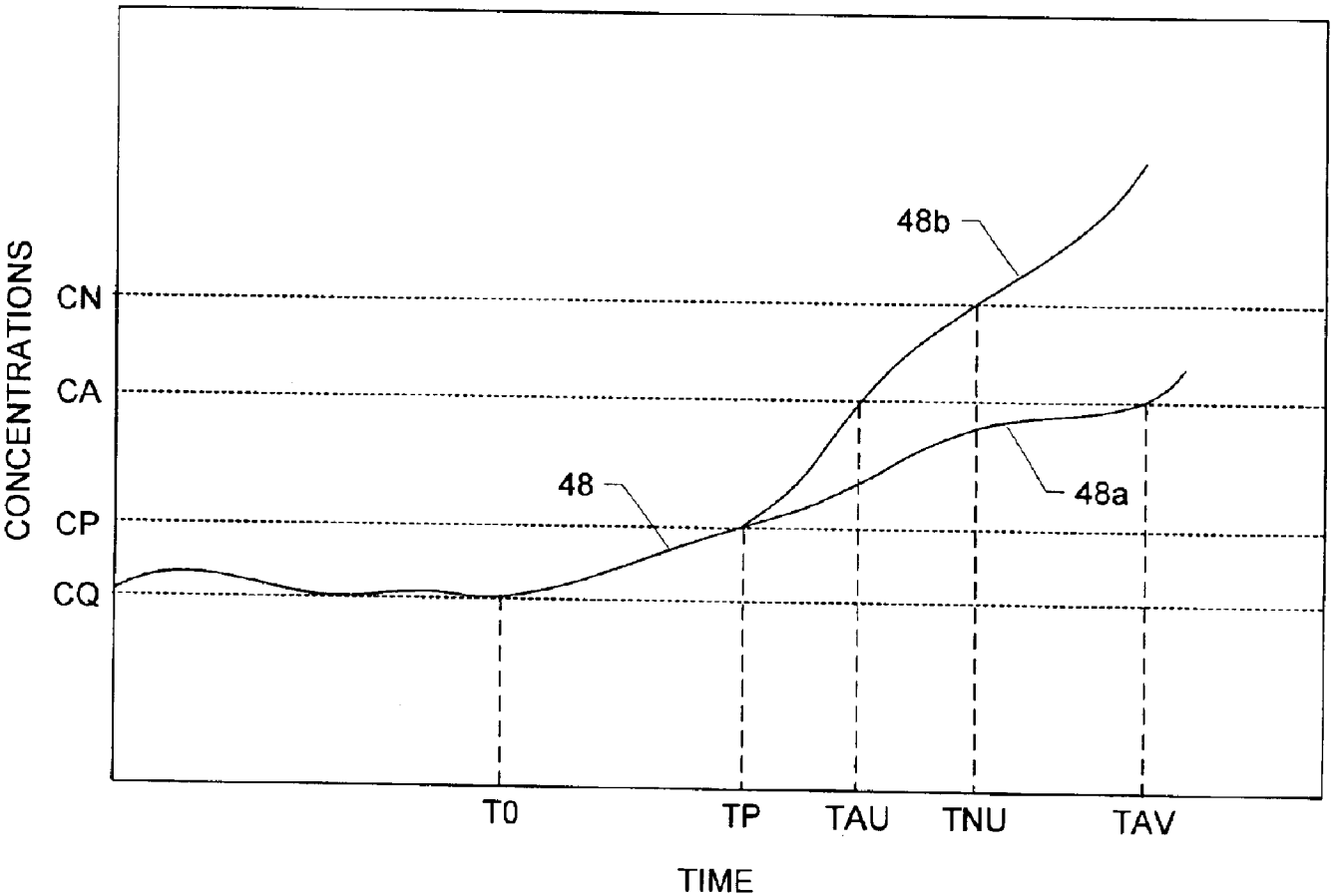

Having thus described the invention in general terms, reference will now be made to the accompanying drawings, which are not necessarily drawn to scale, and wherein:

FIG. 1 is a schematic illustration showing the progression of a plume of smoke within an unventilated enclosure;

FIG. 2 is a schematic illustration showing the progression of a plume of smoke within a ventilated enclosure;

FIG. 3 is a schematic block diagram of a detection system according to one embodiment of the present invention;

FIG. 4 is a flow chart illustrating various steps in a method of detecting a hazardous condition according to one embodiment of the present invention;

FIG. 5 is a graph illustrating a comparison of the reaction time of a conventional smoke detection system and a detection system according to one embodiment of the present invention;

FIG. 6 is a graph illustrating a comparison of the reaction time of a conventional smoke detection system and a detection system according to one embodiment of the present invention where the hazardous condition comprises a small fire; and FIG. 7 is a graph illustrating a comparison of the reaction time of a conventional smoke detection system and a detection system according to one embodiment of the present invention which has a lower sensitivity (or a higher alarm threshold) than the conventional smoke detection system.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring to FIG. 3, a detection system 22 is provided for detecting a hazardous condition within an enclosure 24 that includes a ventilation system, where the ventilation system is capable of controlling airflow through the enclosure. The system can be capable of detecting any of a number of different hazardous conditions, as such are known. For example, the system can detect predefined aerosols, predefined particulates, such as smoke 25 and/or gaseous products, such as carbon monoxide, respectively. Additionally, or alternatively, the system can detect hazardous conditions such as fire 27, such as by detecting undesirably high temperatures and/or by detecting smoke. The system can also be adapted for use in any one of a number of different enclosures that include a ventilation system. In the context of an aircraft, for example, the enclosure may comprise a baggage or cargo compartment, a crew rest, a lavatory, or any of a number of remote volumes, etc.

The ventilation system of the enclosure 24 includes at least one air inlet 26 whereby air enters the enclosure, and at least one air outlet 28 whereby air exits the enclosure. The air inlets and outlets are controllably operable to be opened, either fully or partially, or closed. The air inlets and outlets can comprise any of a number of different devices capable of controllably permitting air to enter and exit the enclosure, respectively. For example, the air inlets and outlets can comprise valves, pumps, fans or the like. Thus, the ventilation system can operate in either an on mode or an off mode. In the on mode, the ventilation system and, thus, the air inlets and outlets, permit air to flow through the enclosure. In contrast, in the off mode, the ventilation system prevents air from flowing through the enclosure. In addition to the air inlets and outlets, it will be appreciated that the ventilation system can include any of a number of other known elements and/or systems, such as to allow the ventilation system to control temperature within the enclosure. In this regard, the air inlets and outlets can be controllable by such additional elements and/or systems to permit different amounts of air to flow through the enclosure to thereby control temperature within the enclosure.

The detection system 22 includes at least one detector 30 capable of detecting at least one level or value of a predefined parameter representing the severity of at least one hazardous condition, where each level is associated with a pre-alarm threshold and an alarm threshold. The detectors can comprise any of a number of different known detectors capable of detecting one or more hazardous conditions, such as predefined aerosols (e.g., smoke), gaseous products (e.g., carbon monoxide) and/or a fire. For example, where one or more of the detectors are capable of detecting smoke, such detectors can comprise any of a number of different smoke detectors manufactured according to the Underwriters Laboratories, Inc. (UL) Standard for Safety UL268. In embodiments where one or more of the detectors are capable of detecting fire based upon an undesirably high temperature, such detectors can comprise any of a number of different heat detectors manufactured according to the UL Standard for Safety UL521. Also, for example, where one or more of the detectors can detect carbon monoxide, such detectors can comprise any of a number of different gas detectors manufactured according to the UL Standard for Safety UL2034. The detectors can be located in any one of a number of different locations relative to the enclosure as long as the detectors are in fluid communication with the enclosure. For example, the detectors can be secured inside the enclosure on the ceiling 24*a*, floor 24*b* or one of the walls 24*c* of the enclosure. As described below, one level representing the severity of a hazardous condition may comprise a concentration of smoke. It should be understood, however, that the concentration of smoke is only one of a number of different measures representing the severity of hazardous conditions capable of being detected by the detectors. Other measures that can represent the severity of the hazardous condition can comprise, for example, a concentration of a predefined gas, such as carbon monoxide, and/or a temperature level. Also, as described below the system may operate to detect one parameter representing the severity of one hazardous condition and function based upon such parameter. It should also be understood, however, that the system can operate to detect one or more parameters and function based upon such one or more parameters, or a combination thereof, without departing from the spirit and scope of the present invention.

In addition to the detectors 30, the detection system 22 includes a controller 32 in electrical communication with the detectors and the ventilation system or, more particularly, the air inlets 26 and air outlets 28. In this regard, the controller can receive the level representing the severity of the hazardous condition from the detectors, and control the ventilation system based upon the level. The controller can comprise any of a number of different processing devices, such as a personal computer or other high level processor. Advantageously, the controller can alternatively comprise a low level processor, a field programmable gate array (FPGA) or an application specific integrated circuit (ASIC) that includes logic configured to operate according to the present invention. The controller can be located in any of a number of different manners relative to the enclosure 24, detectors and ventilation system. For example, the controller can be located at a central location relative to the enclosure, the detectors, and/or the ventilation system. Alternatively, the controller can be located within one or more detectors, particularly when the controller comprises an ASIC.

More particularly according to one embodiment, the controller 32 can receive the parameter, such as the concentration of smoke 25, detected by one or more of the detectors 30. The controller can then compare the parameter(s) to a pre-alarm threshold and an alarm threshold, where the alarm threshold is higher than the pre-alarm threshold. If the parameter is above the pre-alarm threshold, the controller can operate the ventilation system in the off mode. By operating the ventilation system in the off mode, the ventilation system can at least partially close and, in one advantageous embodiment, completely close to thereby at least partially prohibit the flow of air through the enclosure 24. If the parameter detected then raises to a level above the alarm threshold, then, the controller can report the hazardous condition (e.g., fire). The controller can report the hazardous condition in any one of a number of different manners. For example, the controller can actuate an audible and/or visual alarm. Additionally, or alternatively, for example, the controller can provide a notification on a control panel, such as a control panel viewable by a crew member when the detection system is utilized with an enclosure onboard an aircraft.

As explained more fully below in conjunction with the plots of FIGS. 5–7, with the ventilation system of the enclosure 24 operating in the on mode, a parameter, such as smoke, detected by the detectors 30 will rise slowly due to airflow through the enclosure diluting the concentration of smoke throughout the enclosure (see FIG. 2). By operating the ventilation system in the off mode when the concentration of smoke reaches the pre-alarm threshold, the concentration of smoke can increase faster, as the airflow through the enclosure provided by the ventilation system no longer dilutes the concentration of smoke (see FIG. 1). Therefore, by causing the concentration of smoke to increase faster, the reaction time of the detection system can be advantageously shorter than the reaction time of a conventional smoke detection system.

The pre-alarm and alarm thresholds associated with each level or parameter representative of the severity of a respective hazardous condition can be set in any one of a number of different manners, typically depending upon the desired response time of the detection system 22 relative to the start of the respective hazardous condition, and/or depending upon the desired sensitivity of the detectors 30. In one embodiment, then, the alarm thresholds are set in a manner conventional in the art with respect to the particular enclosure 24 and desired response time of the respective detectors. For example, when the enclosure comprises a cargo or baggage compartment on an aircraft and the parameter comprises a concentration of smoke, the alarm threshold can be set at 9% per foot obscuration.

The pre-alarm thresholds can be set at any value lower than the alarm thresholds but, in one preferred embodiment, the pre-alarm threshold is set at a value between a quiescent or background level of the respective parameter and the alarm threshold. For example, continuing the above example where one alarm threshold is set at 9% per foot obscuration and the quiescent concentration of smoke is defined as 0% per foot obscuration, the pre-alarm threshold for detecting smoke can be set between the alarm threshold and the quiescent concentration at 6% per foot obscuration.

If the parameter does not reach the alarm threshold within a predefined amount of time of reaching the pre-alarm threshold and altering the ventilation system, such as ten minutes, the controller 32 can return the ventilation system back to the on mode to again allow airflow through the enclosure 24 or can otherwise increase the airflow permitted by the ventilation system. If the controller desires to return, or does return, the ventilation system back into the on mode or otherwise opens the ventilation system after the predefined time, but the parameter remains above the pre-alarm threshold, however, the controller can be configured to react in any one of a number of different manners. For example, the controller can keep the ventilation system in the off mode, or immediately operate the ventilation system back in the off mode, and thereafter continue to monitor the level to determine if the level exceeds the alarm threshold within the predefined amount of time.

Alternatively, the controller 32 can increase the pre-alarm threshold by a percentage of the difference between the pre-alarm threshold and the alarm threshold for each predefined period of time that the parameter remains between the pre-alarm threshold and the alarm threshold. For example, if the parameter is between the pre-alarm threshold and the alarm threshold after the predefined period of time, the controller can increase the pre-alarm threshold by 25% of the difference between the pre-alarm threshold and the alarm threshold. The detectors can then again detect the parameter, and the controller can compare the parameter to the increased pre-alarm threshold and the alarm threshold for the predefined period of time. If after the second predefined period of time, the parameter remains between the increased pre-alarm threshold and the alarm threshold, the controller can again increase the pre-alarm threshold by 25% of the difference between the original pre-alarm threshold and the alarm threshold. The following cycle can then continue again for subsequent predefined periods of time.

At some point, then, one of three conditions will occur: (1) the parameter will fall below the pre-alarm threshold such that the controller operates the ventilation system back in the on mode; (2) the controller will increase the pre-alarm threshold above the parameter and thereafter operate the ventilation system in the on mode; or (3) the parameter will rise above the alarm threshold such that the controller reports the hazardous condition. Under any of the three conditions, then, the ventilation system will either be returned to the on mode or otherwise at least partially opened, or a hazardous condition will be reported, as under normal operating conditions.

Reference is now drawn to FIG. 4, which illustrates various steps in a method of detecting a hazardous condition according to one embodiment of the present invention. The method begins by operating the ventilation system of the enclosure 24 in the on mode to thereby permit airflow through the enclosure, as shown in block 34. As air flows through the enclosure, a level or parameter representative of the severity of the hazardous condition is detected, such as by the detectors 30, as shown in block 36. A determination can then be made as to whether the parameter exceeds the pre-alarm threshold, as shown in block 38. For example, the detectors can transfer the parameter to the controller 32, which thereafter compares the parameter to the pre-alarm threshold. If the parameter is not higher than the pre-alarm threshold, the parameter is repeatedly detected and compared to the pre-alarm threshold to determine if the parameter exceeds the pre-alarm threshold.

If the parameter exceeds the pre-alarm threshold, the ventilation system is operated in the off mode, such as by the controller 32, to thereby at least partially prevent airflow through the enclosure 24, as shown in block 40. By preventing airflow through the enclosure, an increase in the parameter is facilitated in situations in which a hazardous condition is present. For example, when the hazardous condition comprises a fire and the parameter represents a concentration of smoke, shutting off or otherwise partially closing the ventilation system facilitates an increase in the concentration of smoke in the enclosure. Advantageously, when the hazardous condition comprises fire, shutting off the ventilation system also facilitates controlling the fire as preventing airflow through the enclosure prevents the fire from receiving the oxygen that would otherwise facilitate propagation of the fire.

After the ventilation system has been operated in the off mode, the parameter is again detected to determine if the level exceeds the alarm threshold, as shown in block 42. As before, for example, the detectors 30 detect the parameter and thereafter transfer the parameter to the controller 32, which thereafter compares the parameter to the alarm threshold. If the parameter is not higher than the alarm threshold, the parameter is repeatedly detected and compared to the alarm threshold to determine if the parameter exceeds the alarm threshold.

The parameter is repeatedly detected and compared to the alarm threshold for a predefined time, as shown in block 44. If, after the predefined time, the parameter is below the alarm threshold, the ventilation system can be returned to the on mode (see block 34) or otherwise partially opened, such as by the controller 32, and the method of detecting a hazardous condition can be restarted. If the detected level exceeds the alarm threshold, however, the hazardous condition is reported, such as by the controller, as shown in block 46. For example, the controller can report the hazardous condition by actuating an audible and/or visual alarm to thereby alert appropriate personnel that a hazardous condition exists in the enclosure.

To illustrate the benefits of embodiments of the system and method of the present invention, consider the graphs shown in FIGS. 5 and 6, which plot concentrations of smoke detected by the detectors 30 versus time. As shown, with the ventilation system of the enclosure operating in the on mode, CQ represents the quiescent concentration, CP represents the pre-alarm threshold concentration and CA represents the alarm threshold. At a time T0, the concentration of smoke (designated by line 48) detected by the detectors begins to rise above the quiescent concentration, which can be indicative of a fire 27 within the enclosure 24. With a conventional smoke detection system, the concentration detected by the detectors will rise slowly (designated by line segment 48*a*) due to airflow through the enclosure diluting the concentration of smoke throughout the enclosure (see FIG. 2). The concentration of smoke will continue to slowly rise until the concentration reaches the alarm threshold CA at time TAV, at which point the concentration of smoke triggers an alarm in the conventional smoke detection system. The total time between the likely start of the fire T0 and the time at which the alarm is triggered TAV thereby defines the reaction time of the conventional smoke detection system.

In contrast to a conventional smoke detection system, the detection system 22 of embodiments of the present invention will shut off the ventilation system at the pre-alarm threshold CP at time TP. With the ventilation system shut off, the concentration of smoke increases faster (designated by line segment 48*b*), as the airflow through the enclosure provided by the ventilation system no longer dilutes the concentration of smoke (see FIG. 1). The concentration continues to rise until the concentration reaches the alarm threshold CA at time TAU, where, in the illustrated graph, the alarm threshold is the same as in the conventional smoke detection system. Similar to the conventional smoke detection system, when the concentration of smoke reaches the alarm threshold, the controller reports the hazardous condition (i.e., fire), such as by actuating an alarm. The reaction time of the detection system can be defined as the time between the likely start of the fire T0 and the time at which the alarm is triggered TAU. As shown, then, the reaction time of the detection system of this embodiment of the present invention is advantageously shorter than the reaction time of the conventional smoke detection system.

To further illustrate the benefits of the system and method of embodiments of the present invention, consider the graph illustrated in FIG. 6, which illustrates a small fire, as described in the background section. As described in the background section and shown in FIG. 6, utilizing a conventional smoke detection system, the ventilation system prevents detection of the fire altogether as the airflow provided by the ventilation system causes the concentration of smoke in the enclosure (designated 48*a*) to stop increasing when the quantity of the smoke exhausted from the enclosure via the air outlets 28 is equal to the quantity generated by the fire. As a result, the concentration of smoke does not reach the alarm threshold CA, thereby allowing the small fire to propagate undetected. With the detection system 22 and method of this embodiment of the present invention, however, the controller 32 shuts off the ventilation system when the concentration of smoke reaches the pre-alarm threshold CP. The ventilation system thus prevents airflow through the enclosure such that the concentration of smoke can continue to increase (designated 48*b*) until the concentration of smoke reaches the alarm threshold CA at time TAU.

As also stated in the background section, one of the biggest problems with conventional smoke or fire detection systems is the frequency of false alarms caused by nuisance sources such as dust, moisture, and/or gasses. As the reaction time of the detection system and method of embodiments of the present invention is shorter than the reaction time of conventional detection systems, it will be appreciated that (1) the detection system 22 of embodiments of the present invention can be more responsive than conventional detection systems, or (2) the alarm threshold utilized by the detection system and method of embodiments of the present invention can be set higher than the alarm threshold of conventional detection systems to decrease the frequency of false alarms while having a reaction time that is shorter than that of conventional detection systems. Increasing the alarm threshold, in turn, decreases the sensitivity of the detection system and method of such embodiments thereby decreasing the likelihood that a nuisance source will cause the parameter to rise above the alarm threshold.

Increasing the alarm threshold will increase the reaction time of the detection system and method of such embodiments. To retain the benefits of the present invention, then, the alarm threshold of such embodiments can be set such that the reaction time of the detection system and method of such embodiments increases to any of a number of different reaction times as long as the reaction time does not exceed the reaction time of the conventional detection system, thereby making the new system at least as responsive. Referring to FIG. 7, then, the alarm threshold can be increased to CN, which is higher than the previous alarm threshold CA. As shown, the reaction time of the detection system and method of such embodiments of the present invention increases from TAU to TNU, although TNU is still less than TAV, that is, the time at which a conventional system would respond.

The alarm threshold CN can therefore be set at any one of a number of different values higher than the alarm threshold CA of a conventional system. For example, when the parameter comprises a concentration of a gaseous product such as smoke, the alarm threshold can be set at 12% per foot obscuration where the alarm threshold of conventional detection systems typically cannot not exceed 9% per foot obscuration. As such, by increasing the alarm threshold, the frequency of false alarms decreases, while maintaining the shorter responsiveness of the detection system as compared to conventional detection systems.

In addition to increasing the alarm threshold to decrease false alarms, the detectors 30 and/or the controller 32 can be provided with additional time to discriminate between nuisances sources and sources indicative of the hazardous condition (e.g., smoke), or otherwise compensate for nuisance sources in detecting the level representative of the severity of the hazardous condition. As is known, false alarms can be generated when nuisance sources such as dust, moisture, and/or gasses, are detected at a level exceeding the alarm threshold. The detectors can therefore be configured to include any of a number of elements, devices, assemblies and/or systems designed to discriminate against nuisance sources or otherwise compensate for nuisance sources, as such are known. For example, to compensate for a nuisance source comprising moisture, the detectors can include a moisture compensating devices, as such is described in U.S. Pat. No. 6,377,183 entitled: SMOKE DETECTOR HAVING A MOISTURE COMPENSATING DEVICE, issued on Apr. 23, 2002 to Baker et al., the contents of which are hereby incorporated by reference in its entirety.

As in the case of increasing the alarm threshold, it will be appreciated that configuring the detectors 30 and/or controller 32 to discriminate against nuisance sources or otherwise compensate for nuisance sources may increase the reaction time of the detection system and method of such embodiments. It will also be appreciated, however, that even considering the increase in the reaction time, the reaction time of such embodiments still preferably remains shorter than the reaction time of conventional detection systems.

From the foregoing, operating the ventilation system in the off mode to thereby prevent airflow through the enclosure 24 has the effect of accelerating the increase in the level representative of the severity of the hazardous condition in instances in which a hazardous condition exists in the enclosure. It will be appreciated, then, that operating the ventilation system in the off mode need not completely prevent airflow through the enclosure to accelerate the increase in the level above the rate of increase by operating the ventilation system in the on mode. Thus, operating the ventilation system in the off mode can merely hinder or prohibit air from flowing through the enclosure, without departing from the spirit and scope of the present invention. Thus, although the ventilation system is principally described above in conjunction with on and off modes, the ventilation system may be partially closed/partially open while still accelerating the increase in the parameter.

As described above, the system operates the ventilation system in the off mode and reports a hazardous condition when a parameter representative of the severity of the hazardous condition exceeds a pre-alarm and alarm threshold, respectively. It will be appreciated, however, that the system can additionally, or alternatively, operate such that the system operates the ventilation system in the on mode and reports a hazardous condition when a parameter representative of the severity of the hazardous condition falls below a pre-alarm threshold and an alarm threshold, respectively. For example, the detectors could detect a concentration of oxygen in the enclosure and, if the concentration falls below a pre-alarm threshold, the system opens an otherwise closed or partially closed ventilation system to permit oxygen to enter the enclosure. If, after opening the ventilation system, the concentration falls below the alarm threshold, the hazardous condition (i.e., inadequate supply of oxygen in the enclosure, is reported.

Just as the system can operate in the on mode and off mode based upon the parameter falling below the pre-alarm threshold and the alarm threshold, it will also be appreciated that the system can also perform in a manner similar to that above. For example, in such embodiments, the system can return the ventilation system to the off mode if, after a predefined period of time, the parameter is below the pre-alarm threshold and above the alarm threshold. Similarly, for example, the system can decrease the pre-alarm threshold by a percentage of the difference between the pre-alarm threshold and the alarm threshold for each predefined period of time that the parameter remains between the pre-alarm threshold and the alarm threshold.

Therefore, the present invention provides a system, controller and method of detecting a hazardous condition in an enclosure including a ventilation system. The system, controller and method of embodiments of the present invention are capable of detecting hazardous conditions with a reaction time shorter than conventional detection systems and methods. Advantageously, the system, controller and method of embodiments of the present invention can detect hazardous conditions with a shorter reaction time, while also operating with a higher alarm threshold than conventional detection systems and methods. The system, controller and method of embodiments of the present invention can detect levels with a shorter reaction time while additionally, or alternatively, discriminating against, or otherwise compensating for, nuisance sources. As such, the system, controller and method of such embodiments can operate with fewer false alarms than conventional detection systems and methods.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A detection system capable of detecting at least one hazardous condition, wherein the system is adapted for operation in an enclosure including a ventilation system, wherein the ventilation system is capable of operating in an on mode whereby the ventilation system at least partially permits air to pass through the enclosure, and an off mode whereby the ventilation system at least partially prohibits air from passing through the enclosure, said system comprising:

at least one detector capable of detecting at least one level representative of the severity of the at least one hazardous condition within the enclosure, wherein each level representative of the severity of the at least one hazardous condition is associated with a pre-alarm threshold and an alarm threshold that is higher than the pre-alarm threshold; and a controller electrically connected to the at least one detector and the ventilation system of the enclosure, wherein the controller is capable of operating the ventilation system in the off mode when at least one level detected by the at least one detector is above the respective pre-alarm threshold, and wherein the controller is capable of reporting at least one respective hazardous condition when at least one level detected by the at least one detector is above the respective alarm threshold.

2. A detection system according to claim 1, wherein the detection system is capable of detecting at least one predefined gaseous product, and at least one level representative of the severity of the at least one hazardous condition includes a concentration of the at least one predefined gaseous product.

3. A detection system according to claim 1, wherein the detection system is capable of detecting at least one of a particulate and at least one predefined aerosol, and at least one level representative of the severity of the at least one hazardous condition includes a concentration of at least one of the particulate and the at least one aerosol.

4. A detection system according to claim 1, wherein the detection system is capable of detecting a fire, and one level representative of the severity of the hazardous condition includes a predetermined amount of heat.

5. A detection system according to claim 1, wherein the controller is capable of operating the ventilation system in the off mode when at least one level representative of the severity of the at least one hazardous condition is above the respective pre-alarm threshold, and thereafter operating the ventilation system in the on mode if, after a predefined time, the at least one level is below the respective alarm threshold.

6. A detection system according to claim 5, wherein the controller is capable of increasing the respective pre-alarm threshold if, after the predefined time, the at least one level detected by the at least one detector is above the respective pre-alarm threshold and below the respective alarm threshold.

7. A detection system according to claim 1, wherein said controller is capable of automatically operating the ventilation system in the off mode when at least one level representative of the severity of the hazardous condition is above the respective pre-alarm threshold.

8. A detection system according to claim 1, wherein the at least one detector is capable of compensating for at least one nuisance source while detecting at least one level representative of the severity of the at least one hazardous condition within the enclosure.

9. A controller adapted for use in a detection system capable of detecting at least one hazardous condition within an enclosure including a ventilation system, wherein the ventilation system is capable of operating in an on mode whereby the ventilation system at least partially permits air to pass through the enclosure, and an off mode whereby the ventilation system at least partially prohibits air from passing through the enclosure, said controller comprising:

a processing element electrically connected to at least one detector capable of detecting at least one level representative of the severity of the at least one hazardous condition, wherein each level representative of at least one hazardous condition is associated with a pre-alarm threshold and an alarm threshold that is higher than the pre-alarm threshold, wherein the processing element is also electrically connected to the ventilation system of the enclosure such that the processing element is capable of operating the ventilation system in the off mode when at least one level representative of the severity of the at least one hazardous condition detected by the at least one detector is above the respective pre-alarm threshold, wherein the processing element is capable of reporting the hazardous condition when at least one level detected by the at least one detector is above the respective alarm threshold.

10. A controller according to claim 9, wherein the processing element is capable of operating the ventilation system in the off mode when at least one level representative of the severity of the at least one hazardous condition is above the respective pre-alarm threshold, and thereafter operating the ventilation system in the on mode if, after a predefined time, the at least one level is below the respective alarm threshold.

11. A controller according to claim 10, wherein the processing element is capable of increasing the respective pre-alarm threshold if, after the predefined time, the at least one level detected by the at least one detector is above the respective pre-alarm threshold and below the respective alarm threshold.

12. A controller according to claim 9, wherein the processing element is capable of automatically operating the ventilation system in the off mode when at least one level representative of the severity of the at least one hazardous condition is above the respective pre-alarm threshold.

13. A method of detecting at least one hazardous condition in an enclosure including a ventilation system, said method comprising:

operating the ventilation system in an on mode whereby the ventilation system at least partially permits air to pass through the enclosure;

detecting at least one level representative of the severity of the at least one hazardous condition within the enclosure, wherein each level representative of the severity of the at least one hazardous condition is associated with a pre-alarm threshold and an alarm threshold that is higher than the pre-alarm threshold;

operating the ventilation system in an off mode upon detecting that at least one level is above the respective pre-alarm threshold whereby the ventilation system at least partially restricts airflow through the enclosure; and reporting at least one respective hazardous condition when at least one level detected after operating the ventilation system in the off mode is above the respective alarm threshold.

14. A method according to claim 13, wherein detecting at least one level representative of the severity of the at least one hazardous condition includes detecting a concentration of at least one predefined gaseous product.

15. A method according to claim 13, wherein detecting at least one level representative of the severity of the at least one hazardous condition includes detecting a concentration of at least one of a particulate and at least one aerosol.

16. A method according to claim 13, wherein detecting at least one level representative of the severity of the hazardous condition includes detecting a predetermined amount of heat.

17. A method according to claim 13 further comprising operating the ventilation system in the on mode if, at a predefined time after operating the ventilation system in the off mode, the at least one level detected is below the respective alarm threshold.

18. A method according to claim 17 further comprising increasing the respective pre-alarm threshold if, after the predefined time, the at least one level detected is above the respective pre-alarm threshold and below the respective alarm threshold.

19. A method according to claim 13, wherein operating the ventilation system in an off mode comprises automatically operating the ventilation system in the off mode.

20. A method according to claim 13, wherein detecting at least one level comprises detecting at least one level representative of the severity of the at least one hazardous condition while compensating for at least one nuisance source.

21. A detection system capable of detecting smoke, wherein the system is adapted for operation in an enclosure including a ventilation system, and wherein the ventilation system is capable of operating in an on mode whereby the ventilation system at least partially permits air to pass through the enclosure, and an off mode whereby the ventilation system at least partially prohibits air from passing through the enclosure, said system comprising:

at least one detector capable of detecting a concentration of the smoke within the enclosure; and a controller electrically connected to the at least one detector and the ventilation system of the enclosure, wherein the controller is capable of operating the ventilation system in the off mode when the concentration of smoke detected by the at least one detector is above a pre-alarm threshold, wherein the controller is capable of actuating an alarm when the concentration of smoke detected by the at least one detector is above an alarm threshold that is higher than the pre-alarm threshold.

22. A detection system according to claim 21, wherein the controller is capable of operating the ventilation system in the off mode when the concentration of smoke detected by the at least one detector is above a pre-alarm threshold, and thereafter operating the ventilation system in the on mode if, after a predefined time, the concentration of smoke detected by the at least one detector is below the alarm threshold.

23. A detection system according to claim 22, wherein the controller is capable of increasing the pre-alarm threshold if, after the predefined time, the concentration of smoke by the at least one detector is above the pre-alarm threshold and below the alarm threshold.

24. A detection system according to claim 21, wherein the controller is capable of automatically operating the ventilation system in the off mode when concentration of smoke detected by the at least one detector is above a pre-alarm threshold.

25. A detection system according to claim 21, wherein the at least one detector is capable of compensating for at least one nuisance source while detecting the concentration of smoke within the enclosure.

26. A detection system capable of detecting at least one hazardous condition, wherein the system is adapted for operation in an enclosure including a ventilation system, wherein the ventilation system is capable of operating in an on mode whereby the ventilation system at least partially permits air to pass through the enclosure, and an off mode whereby the ventilation system at least partially prohibits air from passing through the enclosure, said system comprising:

at least one detector capable of detecting at least one level representative of the severity of the at least one hazardous condition within the enclosure, wherein each level representative of the severity of the at least one hazardous condition is associated with a pre-alarm threshold and an alarm threshold; and a controller electrically connected to the at least one detector and the ventilation system of the enclosure, wherein the controller is capable of operating the ventilation system in at least one of the on and off modes based upon at least one level representative of the severity of the hazardous condition detected by the at least one detector and the respective pre-alarm threshold, wherein the controller is also capable of reporting at least one respective hazardous condition based upon at least one level detected by the at least one detector and the respective alarm threshold.

27. A detection system according to claim 26, wherein the controller is capable of operating the ventilation system in the off mode when at least one level representative of the severity of the at least one hazardous condition is above the respective pre-alarm threshold, wherein the controller is capable of reporting the hazardous condition when the level is above the respective alarm threshold, and wherein the pre-alarm threshold is lower than the alarm threshold.

28. A detection system according to claim 27, wherein the controller is capable of operating the ventilation system in the off mode when at least one level representative of the severity of the at least one hazardous condition is above the respective pre-alarm threshold, and thereafter operating the ventilation system in the on mode if, after a predefined time, the at least one level is below the respective alarm threshold.

29. A detection system according to claim 28, wherein the controller is capable of increasing the respective pre-alarm threshold if, after the predefined time, the at least one level detected by the at least one detector is above the respective pre-alarm threshold and below the respective alarm threshold.

30. A detection system according to claim 26, wherein the controller is capable of operating the ventilation system in the on mode when the at least one level detected by the at least one detector is below the respective pre-alarm threshold, wherein the controller is capable of reporting the respective at least one hazardous condition when the level detected by the at least one detector is below the respective alarm threshold, and wherein the pre-alarm threshold is higher than the alarm threshold.

31. A detection system according to claim 30, wherein the controller is capable of operating the ventilation system in the on mode when the at least one level detected by the at least one detector is below the respective pre-alarm threshold, and thereafter operating the ventilation system in the off mode if, after a predefined time, the at least one level is above the respective alarm threshold.

32. A detection system according to claim 31, wherein the controller is capable of decreasing the respective pre-alarm threshold if, after the predefined time, the at least one level detected by the at least one detector is below the respective pre-alarm threshold and above the respective alarm threshold.

* * * * *